US008869873B2

(12) United States Patent
Mouthon

(10) Patent No.: US 8,869,873 B2
(45) Date of Patent: Oct. 28, 2014

(54) METHOD FOR MANUFACTURING ANODES

(76) Inventor: Horacio Rafart Mouthon, Calama (CL)

( * ) Notice: Subject to any disclaimer, the term of this patent is extended or adjusted under 35 U.S.C. 154(b) by 484 days.

(21) Appl. No.: 13/079,401

(22) Filed: Apr. 4, 2011

(65) Prior Publication Data

US 2011/0272114 A1 Nov. 10, 2011

(30) Foreign Application Priority Data

May 5, 2010 (CL) ..... 452-2010

(51) Int. Cl.
*B22D 19/00* (2006.01)
*B23H 5/10* (2006.01)
*C25C 7/02* (2006.01)

(52) U.S. Cl.
CPC ..... *C25C 7/02* (2013.01)
USPC ..... 164/91; 164/100; 204/288.2

(58) Field of Classification Search
USPC ..... 204/286.1, 288.2, 297.01, 280, 281; 205/575, 576, 292; 164/47, 113, 91, 164/75, 98, 100
See application file for complete search history.

(56) References Cited

U.S. PATENT DOCUMENTS 4,373,654 A * 2/1983 Prengaman et al. ..... 228/173.1
6,569,300 B1 * 5/2003 Assenmacher ..... 204/286.1

* cited by examiner

*Primary Examiner* — Kevin P Kerns
*Assistant Examiner* — Steven Ha
(74) *Attorney, Agent, or Firm* — Hamre, Schumann, Mueller & Larson, P.C.

(57) ABSTRACT

A method for assembling anodes used in electro winning processes that increases corrosion resistance. The method includes pre-coating the copper bus bar, introducing the copper bar into a mold, peripherally coating the copper bar with a lead-antimony alloy, moving the copper bar to the assembly table, filling a slot in the copper bus bar with a lead-bismuth alloy, introducing the end of a plate into the slot while the lead-bismuth alloy is in a liquid state, and once the lead-bismuth alloy in the slot has solidified, applying reinforcement solder.

12 Claims, 5 Drawing Sheets

Fig. 1 --Prior Art

Fig. 2 --Prior Art

Fig. 3 — PRIOR ART

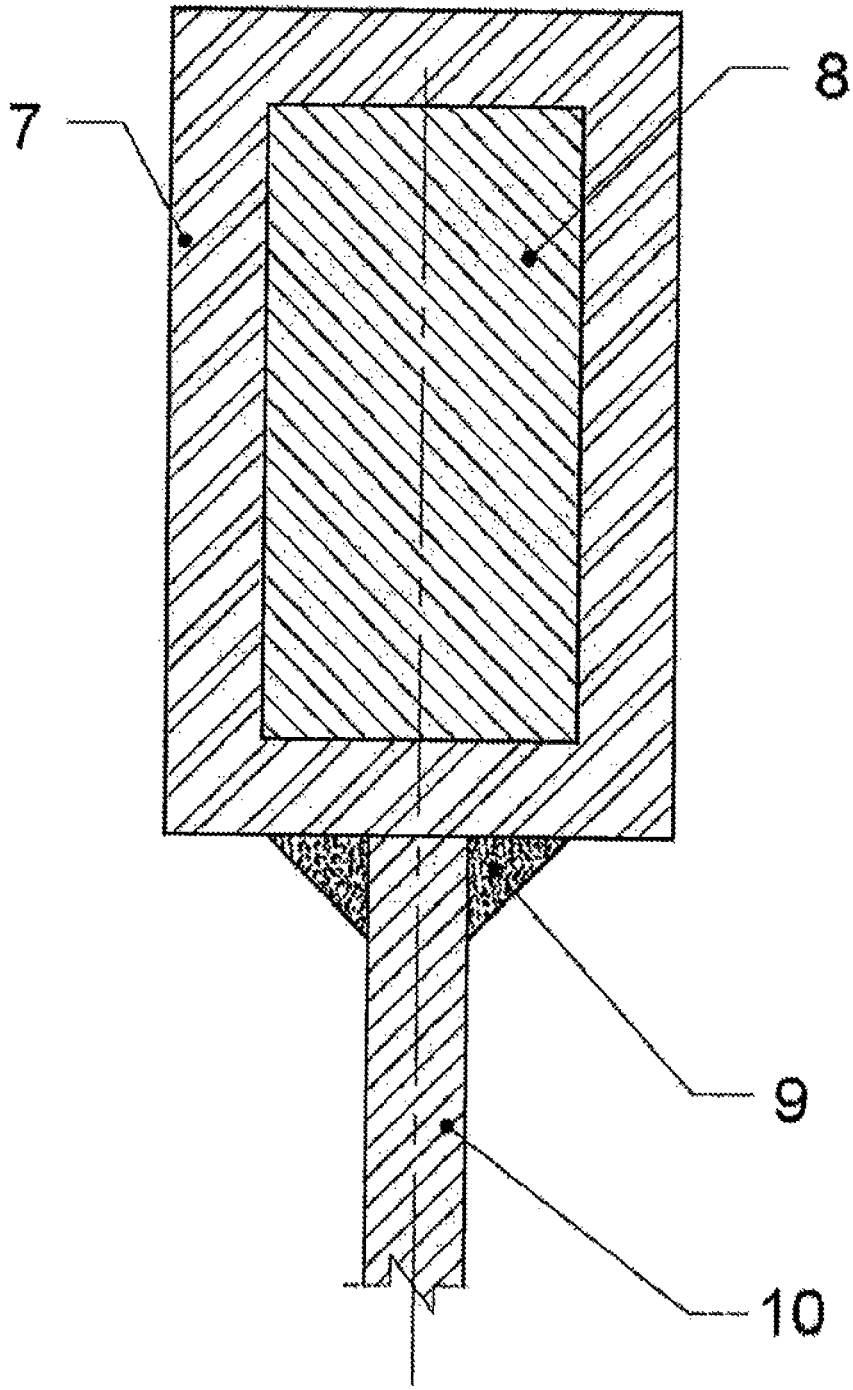
Fig. 5 -- Prior Art

METHOD FOR MANUFACTURING ANODES

FIELD OF THE INVENTION

This invention relates to a coating method or process for manufacturing anodes used in highly pure-metal high-electrowinning or electrorefining processes representing improved characteristics with respect to anodes and to currently known manufacturing methods.

BACKGROUND OF THE INVENTION

It is known that the use of the metal electrowinning and electrorefining process dates back to the 1860's. This technology has further developed to date, where, with the advent of the solvent extraction technology, anodes bear a copper bar to conduct the current, comprising the positive anode for electrowinning purposes.

Two assembled systems have prevailed to date, at the joint between the bus bar-body and the anode, one known as RSR method, and the other known as the Royston method, which correspond to the two companies that developed these methods over two decades ago.

The aforementioned systems are briefly described below:

a) RSR method (see FIGS. 1 and 2): the copper support bar (1), has a slot (2) throughout its straight 6-12 mm wide× 199 mm deep×940 mm long portion (R), into which the laminated plate (3) is inserted. A coating (4A) has been previously made, (FIG. 3) on the copper support bar (1) with a Pb=52%; Sn=45%; Sb=3% alloy, and the slot (2) has been filled with the same alloy (4B); being later soldered to each other (support bar and lead plate), by solder, Pb=94%; Sb=6%; and finally, the entire head of the anode, that is the bus bar, the solder zone and 50 mm, approximately, of the sheet below the solder zone, is covered with a electrowinning deposit of pure lead of up to 0.75 mm. of thickness.

b) Royston method (see FIG. 5): the entire perimeter of the copper support bar (8) is coated with a lead-antimony-based alloy (7), preferably 6% Sb, at least 6 mm thick, and the sheet (10) is later attached to the coating (7) by using solder (9), of an alloy identical to that of the peripheral coating.

The manufacture of anodes through the aforementioned methods, in practice, has shown different mechanical and structural deficiencies over the past two decades, which may be summarized as follows:

I).—An anode produced using the Royston system has poor conductivity, because the sheet is not directly soldered to the copper bar, but to its coating, and II).—in the RSR system, structural distortion in electrowinning processes, and corrosion through the electrowinning lead coating on the copper bar, causes 1.—structural distortion, serious warping problem (anode concave bending) with subsequent occurrence of short-circuits; and 2.—contact problems and, eventually, bar-plate detachment due to corrosion.

The RSR-like joint system shows better conductivity, but it clearly makes apparent, in turn, the conceptual failure of the anode assembly method, which causes this system to cause such a negative bending, of great technical and economic significance to mining users, which, due to process replacement, must be stopped, causing refinery productivity to drop. The RSR system shows significant corrosion on the anode head within the first year of operation, from the destruction of the 0.75 mm thick pure lead electrowinning deposit resulting from the solder on the copper bar that acts as an adhesive element.

There is also the system disclosed in Chilean patent CL42634, which refers to an assembly and construction method for anodes used in electrowinning processes, comprising a copper bus bar in which a slot whose thickness is 0.12 mm more than the thickness of the lead bar that will be fitted into it has been previously milled. The copper bus bar is pre-coated by being submerged in an alloy sheet, preferably Lead between 25% and 27.5%, Bismuth between 25% and 27.5% and between 45% and 50% of Tin, all at 170° C. Then, the bar is moved to the assembly table where the slot is filled with the same cast alloy and at the same temperature, and the lead sheet is immediately introduced. The copper bar starts to cool down while the lead sheet at the joint area starts to heat. After a short period of time, a thermal balance between both bodies is established at 135° C., and both start to cool down from that temperature, their expansion being identical.

When the temperature of the set at the joint area has reached 100° C., reinforcement solder is applied to the area on both sides. The solder consists of a rod solder bead between the copper bar and the lead sheet walls, which alloy is lead-bismuth, with up to 55% of bismuth. With this system copper bar bending is prevented.

SUMMARY OF THE INVENTION

The method of the present invention proposes a manufacture technology that solves all the negative aspects in the aforementioned systems. A structural anode having functionally improved conductivity and excellent corrosion rates is provided, without bending and without detachment of the copper joining bar-lead sheet. This is achieved by way of substantial modifications to the design of the alloys used, where the absence of Tin is their core constituent, in which the level of corrosion is high, as well as on the coating of the anode's copper bar, which no longer is pure lead electrolitically deposited but a cast and thicker lead-antimony alloy, strongly attached by the metallurgical joint between the silver-based solder and the Lead-Antimony coating, unlike the joint resulting from the pure lead electrolytic coating, which is substantially mechanically weaker, in addition to being porous, which causes more intense corrosion. This assembly method improves these aspects and conceptually keeps the bar-body joint with low melting-point solder to prevent bending.

DESCRIPTION OF THE DRAWINGS

FIG. 5 shows the assembled prior art Royston-like anode.

DESCRIPTION OF THE INVENTION

Figure 1:
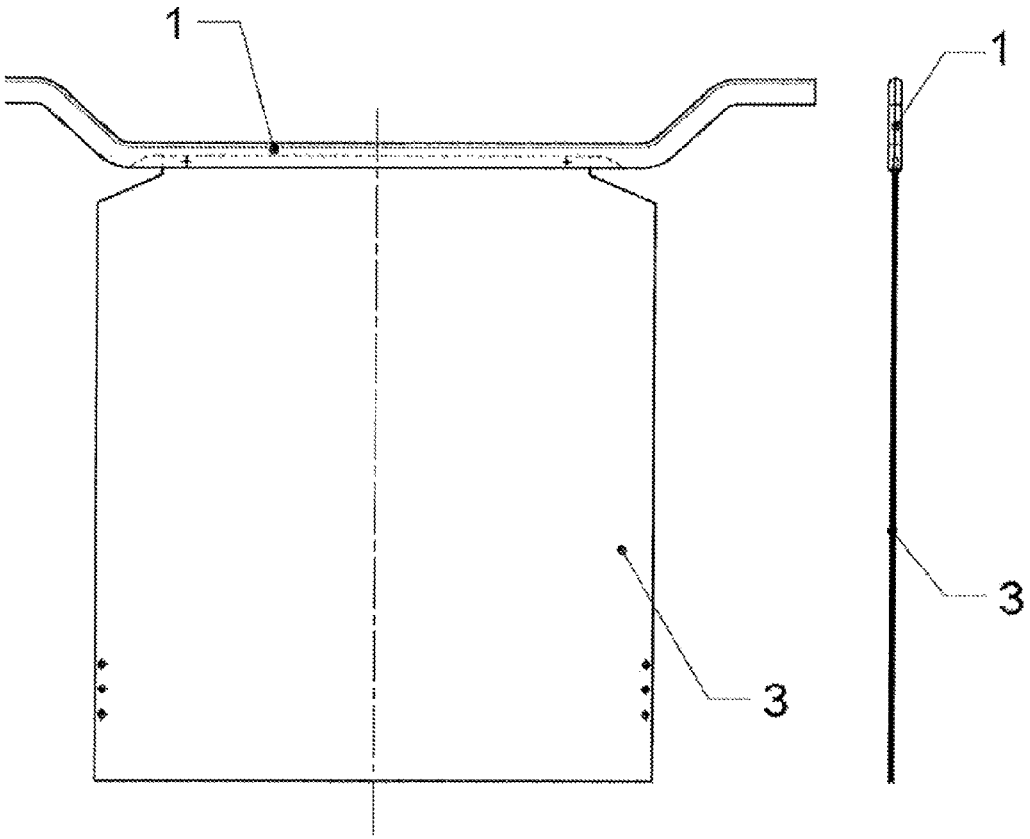
FIG. 1 shows a complete anode resulting from a prior art process.
Figure 2:
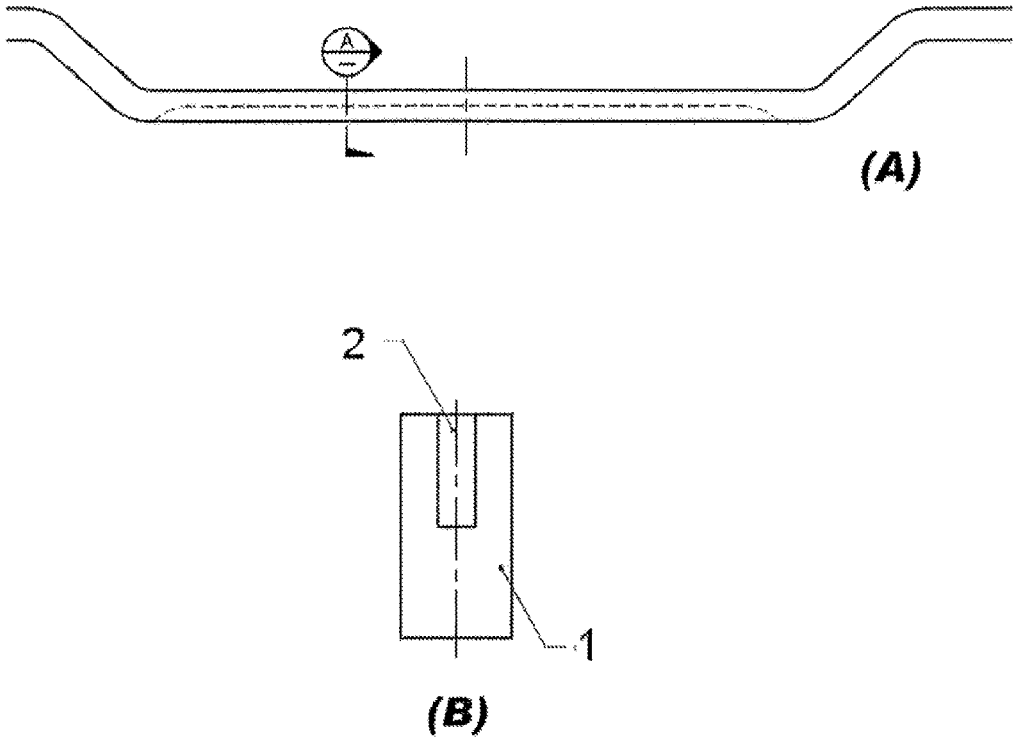
FIG. 2 shows the slotted copper bar in cuts A and B of a prior art process.
Figure 3:
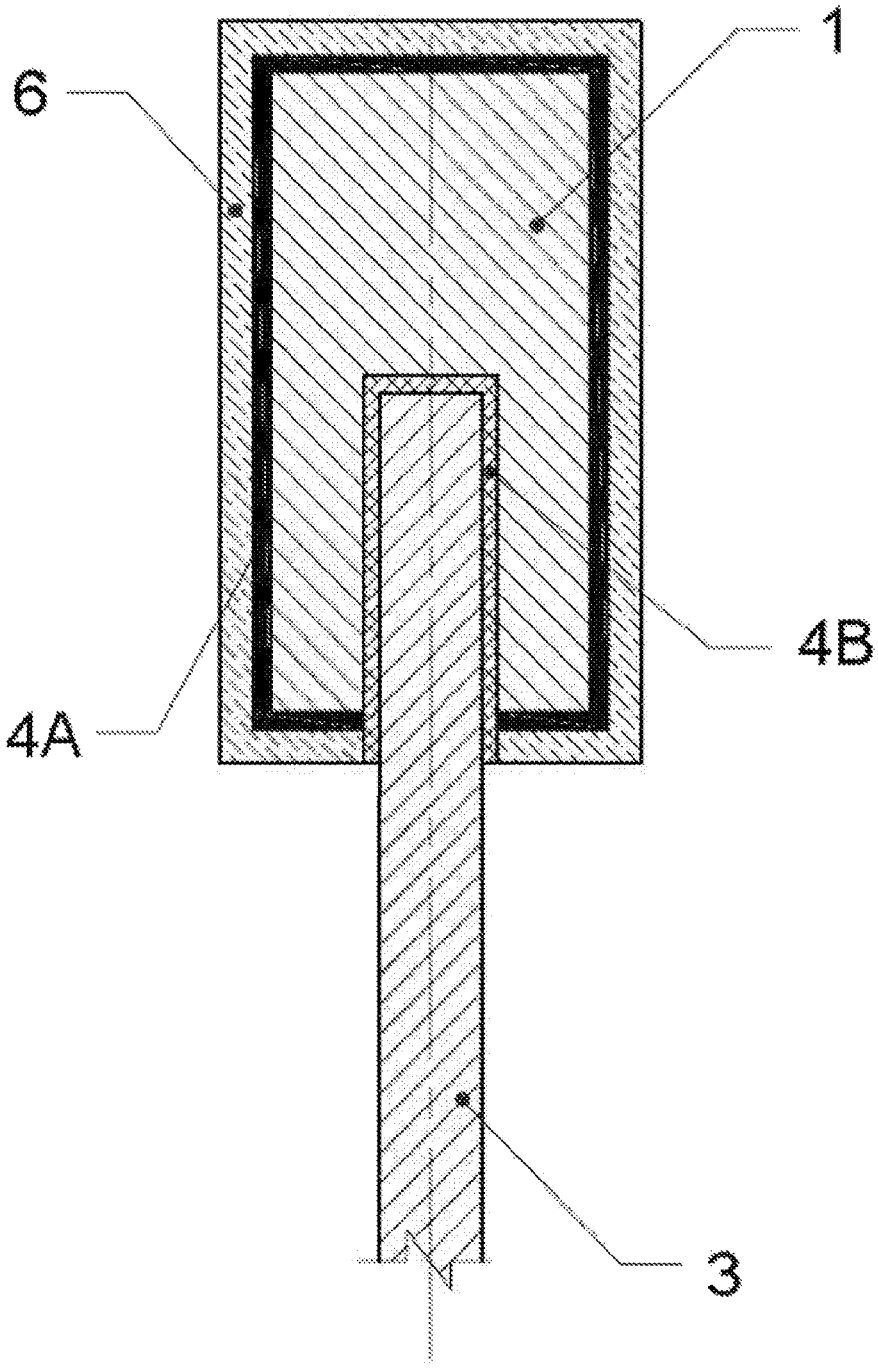
FIG. 3 shows the pre-assembled anode of the prior art after the slot has been filled with alloy and the lead sheet has been inserted.
Figure 4:
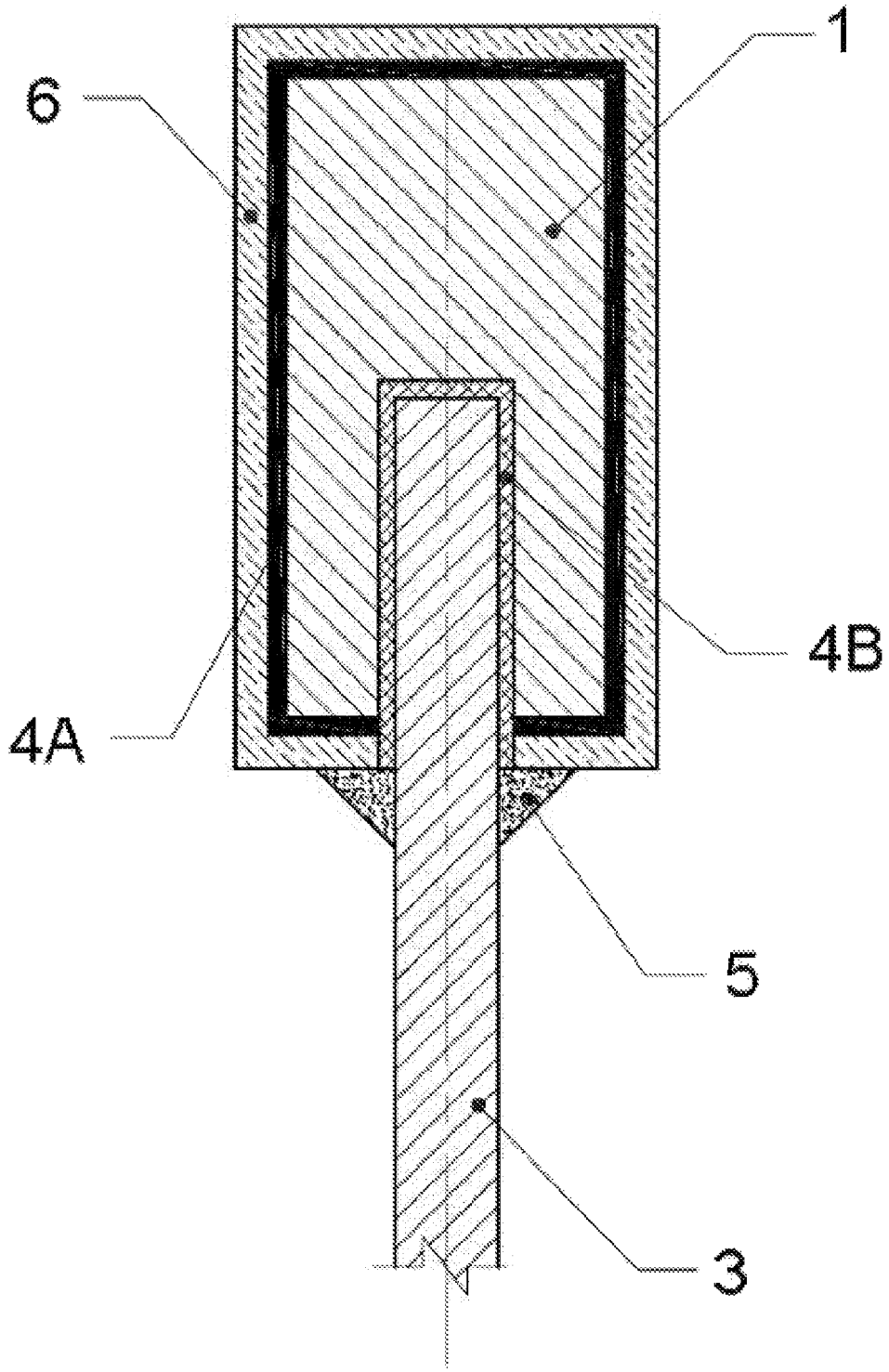
FIG. 4 shows the assembled anode finished with reinforcement solder.

The invention relates to a method for assembling and manufacturing anodes used in electrowinning processes, comprising a copper bus bar (1) with a slot (2) that has been previously milled. The slot has a thickness that is 0.12 mm more than the thickness of the lead bar that will be fitted into the sheet (3), and which is approximately 19 mm deep. The copper bus bar (1) is first solder coated by being pre-coated with a Lead-Silver base alloy, preferably Lead: 97%, Silver: 3%, (4*a*) at an adequate temperature (300-350° C.) FIG. 4, and immediately after, and with the newly coated bar at a 250 to 280° C. temperature, it is introduced into an adequate mold. Through injection or another similar mechanism, the bar is peripherally coated with a 0 to 10% Sb thick Lead-Antimony alloy, preferably 6%, and preferably with a 0.01 and 10 mm thickness, preferably 1.5 mm, (6) FIG. 4. Then, the copper bar, that has been peripherally coated with the Lead-Antimony alloy and still hot, is placed on an adequate assembly table where the slot (2) is filled with a low-melting point cast lead-bismuth alloy in a liquid state and having 1% to 55% of Bismuth, (4*b*) FIG. 4, preferably Lead: 50%-Bismuth: 50%. The Lead-Bismuth solder must be at such temperature that it allows the lead plate to be introduced into the assembly slot, keeping the Lead-Bismuth solder in an absolute liquid state. The lead plate (3) is introduced in to the slot in the copper bar, filled with solder (4*b*). The copper bar (1) starts to cool down, whereas the plate (3) starts to heat. After a short period of time, a thermal balance between both bodies is established at about 135-150° C., and both start to cool down from that temperature, being identically expanded. This will ensure that tension will not be generated at the soldered joint, which is the cause of subsequent anode bending.

When the temperature of the set at the joint area has reached abut 100° C., and the solder (4*b*) had solidified, the reinforcement solder (5) is applied to the area and on both sides. The solder (5) consists of a rod or rodless solder bead between the peripheral coating (6) of the copper bar (1) and the plate walls (3). The solder alloy may be a lead-bismuth alloy, which lead content is greater than 50%.

What is claimed is:

1. A method of assembling anodes, comprising:

a) pre-coating a copper bus bar by cast plating at a temperature between 300° C.-350° C. with an alloy comprising lead and silver;

b) introducing the pre-coated copper bus bar into a mold and coating the pre-coated copper bus bar with a lead-antimony alloy, the lead-antimony alloy coating having a thickness of between 0.01 mm to 10 mm;

c) thereafter removing the copper bus bar from the mold, and filling a slot that is formed in the copper bus bar with a lead-bismuth alloy in a liquid state;

d) introducing an end of a plate into the slot while the lead-bismuth alloy is in a liquid state; and e) once the lead-bismuth alloy in the slot has solidified, applying reinforcement solder to a joint area between the lead-antimony alloy coating and the plate.

2. A method according to claim 1, wherein a center of the slot in the copper bus bar is longitudinally parallel to the copper bus bar.

3. A method according to claim 1, wherein the solder is applied once a temperature balance between the copper bus bar and the plate has been reached.

4. A method according to claim 1, wherein the reinforcement solder is applied when the temperature of the copper bus bar and the temperature of the plate are below a melting point of the lead-bismuth alloy.

5. A method according to claim 1, wherein the pre-coated copper bus bar is at a temperature of between 250° C.-280° C. when introduced into the mold.

6. A method according to claim 1, wherein the lead-antimony alloy coating has a thickness of 1.5 mm.

7. A method of assembling anodes, comprising:

a) pre-coating a copper bus bar with an alloy comprising lead and silver;

b) applying a lead-antimony coating over the pre-coated copper bus bar, the lead-antimony coating having a thickness of between 0.01 mm to 10 mm;

c) thereafter filling a slot that is formed in the copper bus bar with a lead-bismuth alloy that is in a liquid state;

d) introducing an end of a plate into the slot while the lead-bismuth alloy is in a liquid state; and e) once the lead-bismuth alloy in the slot has solidified, applying reinforcement solder to a joint area between the lead-antimony alloy coating and the plate.

8. A method according to claim 7, wherein a center of the slot in the copper bus bar is longitudinally parallel to the copper bus bar.

9. A method according to claim 7, wherein the solder is applied once a temperature balance between the copper bus bar and the plate has been reached.

10. A method according to claim 7, wherein the reinforcement solder is applied when the temperature of the copper bus bar and the temperature of the plate are below a melting point of the lead-bismuth alloy.

11. A method according to claim 7, wherein the pre-coated copper bus bar is at a temperature of between 250° C.-280° C. when the lead-antimony coating is applied.

12. A method according to claim 7, wherein the lead-antimony alloy coating has a thickness of 1.5 mm.

* * * * *